United States Patent [19]

Scrudato

[11] Patent Number: 4,556,012

[45] Date of Patent: Dec. 3, 1985

[54] DISPOSABLE INK CARTRIDGE

[75] Inventor: Frederick Scrudato, Florham Park, N.J.

[73] Assignee: Finast Marking Supplies Inc., Livingston, N.J.

[21] Appl. No.: 617,127

[22] Filed: Jun. 4, 1984

[51] Int. Cl.[4] ..... B05C 1/00

[52] U.S. Cl. ..... 118/268; 118/269

[58] Field of Search ..... 118/264, 268, 269; 220/359

[56] References Cited

U.S. PATENT DOCUMENTS

| | | | |
|---|---|---|---|
| 2,678,626 | 5/1954 | Garvey | 118/264 |
| 3,391,847 | 7/1968 | Christine et al. | 220/359 X |
| 4,209,126 | 6/1980 | Elias | 220/359 X |
| 4,484,827 | 11/1984 | Price, Jr. | 118/268 X |

FOREIGN PATENT DOCUMENTS

| | | | |
|---|---|---|---|
| 757876 | 9/1956 | United Kingdom | 118/264 |

*Primary Examiner*—John P. McIntosh

*Attorney, Agent, or Firm*—Ronald G. Goebel

[57] ABSTRACT

A disposable ink cartridge is provided comprising a container having a top opening, an inwardly extending bottom and an inwardly extending shoulder or rim. An ink absorbent pad such as a sponge is fitted inside the container followed by an ink distributing pad such as a felt pad. The container is sealed by a laminate consisting of a bottom layer of metal foil having a heat sealing polymeric composition on its undersurface and a top layer of paper such as kraft paper. The felt pad has a hole located therein which equalizes the pressure between the surface of the felt and the inside of the cartridge.

11 Claims, 7 Drawing Figures

DISPOSABLE INK CARTRIDGE

BACKGROUND OF THE INVENTION

This invention is concerned with a throw-away or disposable ink cartridge particularly useful in code dating machines.

Code dating machines are marking devices which print certain indicia in ink on labels and packages for foods and other goods. Such machines generally include a frame assembly to which is mounted a reciprocating positioning mechanism for a printing head having raised indicia thereon, usually made of rubber and adapted to be displaced between an ink receiving position and a marking position. In the marking position, the printing head engages the substrate to be printed. To achieve the ink receiving position, the printing head is intermittently displaced from its marking position to an ink storage device or cartridge also mounted on the frame. The printing head engages the ink storage device to receive a supply of ink therefrom and then is returned by the positioning mechanism to the marking position where the substrate is printed. The process continues in reciprocating fashion until the ink supply in the ink storage device is expended.

Prior ink storage devices or cartridges employed with such marking devices have to be refilled with an ink supply after they are expended through use. This is often a tedious and messy operation causing the user to contaminate his hands and clothes with ink and expending valuable time. If the user decides to fill many cartridges at once and use one while storing the others the solvent vehicle for the ink evaporates from the cartridge due to the inadequate sealing means covering the cartridge. More recently cartridges have been developed which are disposable, non-refillable and have long shelf lives hence avoiding the above problems. Many disposable cartridges employ a layer of felt or the like mounted atop an absorbent sponge material in the cartridge wherein the felt layer engages the printing head in the ink receiving position. Oftentimes flooding occurs in these cartridges which arises from changes in temperature. When a cartridge containing a felt overlayer is exposed to low temperatures the felt and sponge contract and the ink becomes quiessent. Consequently the felt layer does not become ink saturated. However, when the temperature rises to room temperature or above the sponge and felt expand and the ink becomes active or non-quiessent and is caused to flow to the felt surface and flood the top of the cartridge. As a result the user must decant the excess ink from the cartridge or blot it out of the cartridge prior to use. This materially reduces the usuable life of the cartridge.

The present invention provides a disposable ink cartridge for marking devices comprising a sponge overlaid by a felt layer which can be used until its ink supply is expended and then disposed of and which contains a means for preventing the flooding of the cartridges as a result of temperature differences. In another embodiment of the invention, means associated with the felt layer are provided to filter undissolved materials from the ink supply into the cartridge.

SUMMARY OF THE INVENTION

The cartridge of this invention comprises a container having a top opening, an upwardly extending bottom and an inwardly extending shoulder or rim surrounding the top opening. An ink absorbent pad such as a sponge is fitted inside the container followed by an ink distributing fibrous pad such as a felt pad. Such distributing pad is retained in the container by the shoulder. The ink distributing pad contains a small hole located inwardly at a point distant from its edge which is not covered by the printing head when it engages the pad in the ink receiving position. A sealing means is placed over the top opening comprising a laminate consisting of a lower face layer having a heat sealing polymeric composition on its undersurface, an intermediate polymeric layer, and a top layer of covering material such as kraft paper. A cartridge of circular cross-section and a cartridge of rectangular cross-section are provided herein. The invention also provides a thin polymeric layer underlying the ink distributing pad to filter undissolved resins or dyes from the ink.

DETAILED DESCRIPTION OF THE PREFERRED EMBODIMENTS

Figure 1:
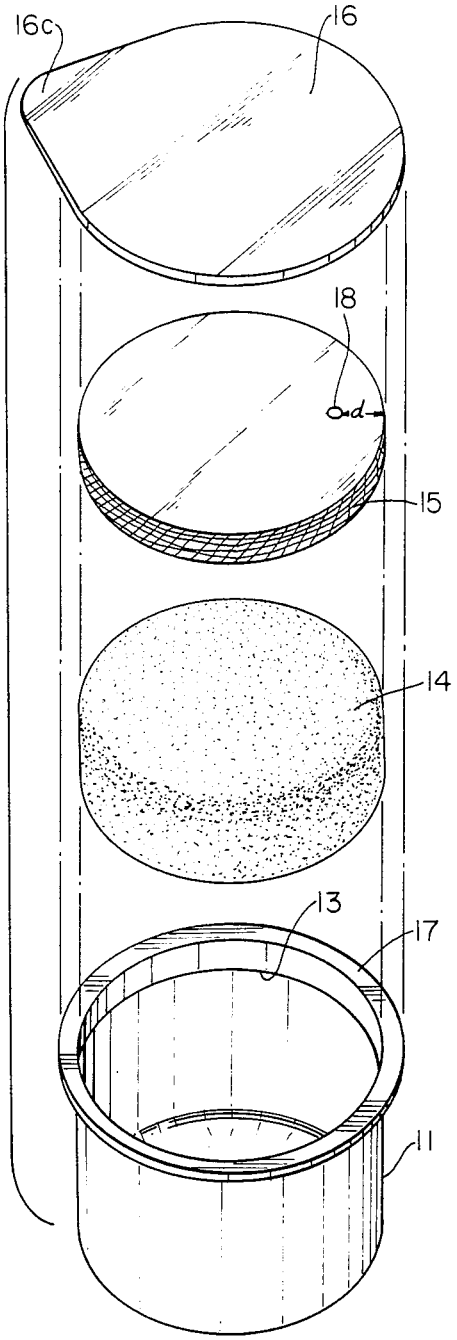
FIG. 1 is an exploded view of a cylindrical cartridge according to the invention.
Figure 2:
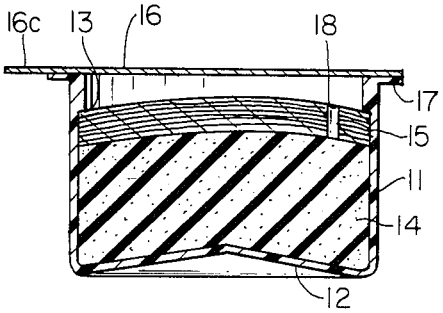
FIG. 2 is a sectional side view of an assembled cartridge.

Referring to FIGS. 1 and 2, a cylindrical disposable ink cartridge 11 is shown preferably comprised of an injection-molded plastic such as polyethylene having an upwardly concave bottom 12 and a flat annular lip 17 surrounding its open end. The top inside portion of the cartridge has formed therein annular retaining shoulder 13. Ink for marking purposes is placed in the cartridge and a cylindrical sponge material 14 is inserted in the bottom of the cartridge against the concave bottom. A cylindrical felt pad 15 having hold 18 formed therein is pressed down over the sponge material 12. Hole 18 is preferably about 1/16 inch and is located a distance d about $\frac{1}{4}$ inch from the outside edge of the felt layer. Such hole is not contacted by the printing head in the ink receiving position when the cartridge is inserted in the reciprocating machine. The felt pad 15 and sponge 14 are held within the cartridge by the annular retaining shoulder 13. The sponge and felt pad bulge slightly upwardly in response to the upward pressure produced in the cartridge by concave bottom 12. The upwardly bulged configuration of the sponge material and felt pad promotes a pumping action of ink to the sponge material as the printing head alternately compresses and releases compression of the felt pad and sponge material toward the bottom of the cartridge.

A heat sealable laminated cover 16 is secured to annular lip 17 or flange of the cartridge by the application of heat to complete the assembly as shown in FIG. 2.

Figure 3:
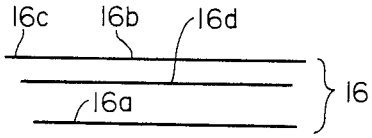
FIG. 3 shows the layers of the heat sealable laminated cover.

FIG. 3 shows the upper, intermediate and lower layers of laminated cover 16. The cover 16 comprises a lower layer 16*a* made of metallic foil such as aluminum foil having a heat sealable coating extrusion coated on the undersurface thereof, said coating comprising a polymeric composition which when heated to temperatures ranging from about 350° F. to 500° F. forms a hermetic peelable heat seal on the annular lip 17. An intermediate layer 16*d* of polyethylene is also provided which is bonded to lower layer 16*a* by means of an adhesive. An upper layer of paper 16*b* such a kraft paper is bonded to intermediate layer 16*d* by means of an adhesive. The laminated cover may be removed from the cartridge by peeling tab 16*c* back over the top.

The heat sealable laminated cover 16 effectively prevents evaporation and leakage of the solvent carrier of the ink supply. This allows the ink-filled cartridge to be stored prior to use without loss of volatile ink.

The hole 18 in the felt is an important aspect of the invention. Although the mechanism is not known precisely it is believed that it equalizes the pressure between the upper surface of the felt layer and the remaining portion of the cartridge so that ink in the cartridge will not tend to rise to the surface of the felt in response to a change in temperature or if the ink does rise it will be reabsorbed by the felt and sponge. It has been found in comparative experiments employing a felt layer with a hole and a felt layer without a hole as used in the prior art in a cartridge as described above that the cartridge containing the felt layer with a hole had a useful life during printing of 8 hours while the cartridge without a hole had a useful life of only 4 hours because a large excess of ink which had to be removed prior to use. It is also essential that the hole in the felt layer be spaced from the edge of the felt a distance outside or less than that of the contact area of the printing head with the felt when the cartridge is in operation, that is, the printing head should not cover the hole. If the hole were located in an area which is covered by the printing head it would cover the hole on printing and would receive too much ink in the area of the hole and consequently would print indicia with too much ink. The hole should generally be located a distance of ¼ from the edge of the felt for satisfactory results. The size of the hole is not particularly critical; a 1/16 inch hole serves the purpose quite adequately but may be varied.

Figure 4:
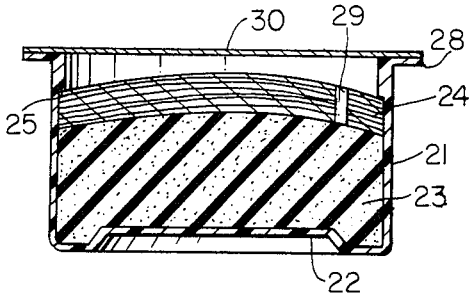
FIG. 4 is a sectional side view of a rectangular cartridge according to the invention.
Figure 5:
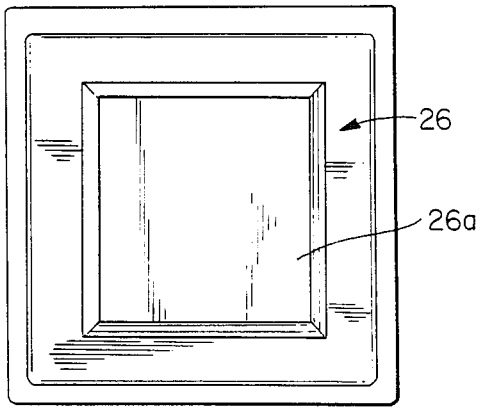
FIG. 5 shows a leak preventive member used with the cartridge of FIG. 4.

FIG. 4 shows another embodiment of the cartridge of this invention having a rectangular cross-section and indicated generally by 21. The cartridge has an upwardly extending bottom 22 serving the same function as the upwardly concave bottom 12 of FIG. 2. The cartridge is equipped with a top flange 28 and upper retaining shoulder 25. A rectangular sponge 23 and felt pad 24 having a hole 29 is retained in the cartridge by the retaining shoulder 25. Mounted over the retaining shoulder 25 is a leak preventive member 26 shown in top view of FIG. 5 having central rectangular aperture 26*a*. This member prevents ink from leaking from the cartridge when the cartridge is tilted from the horizontal and the central aperture allows the printing head to contact the felt pad. A rectangular heat sealable laminated cover 30 having layers as described in connection with FIG. 3 is heat sealed over the flange.

Figure 6:
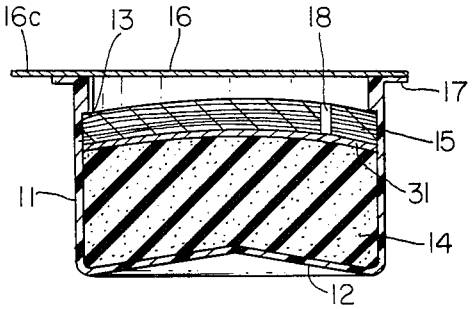
FIG. 6 shows a sectional side view of an ink cartridge similar to the cartridge of FIGS. 1 and 2 with a polymeric layer interposed between the sponge and felt layer.
Figure 7:
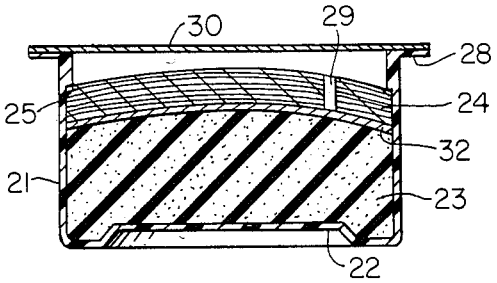
FIG. 7 shows a sectional side view of an ink cartridge similar to the cartridge of FIG. 4 with a polymeric layer interposed between the ink sponge and felt layer.

FIG. 6 shows a cartridge identical to that of FIG. 6 except that a polymeric layer 31 is glued to the underside of felt layer 15. Simultaneously FIG. 7 shows the same cartridge as FIG. 4 with a polymeric layer 32 glued to the underside of the felt. It has been found that the presence of such a layer filters the undissolved resins and dyes from the ink supply.

I claim:

1. An ink cartridge for a code dating maching having a reciprocating printing head which contacts said cartridge comprising:

(a) a hollow container having a top opening and an upwardly extending bottom;

(b) an ink absorbing pad located in said container;

(c) an ink distributing pad located in said container above said ink absorbing pad having a vacant hole extending therethrough terminating at the bottom of said ink distributing pad and being located a distance from the edge of said ink distributing pad short of the area of contact with said printing head; and (d) means located over said opening for sealing said container.

2. The cartridge of claim 1 wherein said means for sealing comprises a heat sealable laminated cover comprising a lower layer of a metallic foil having on the undersurface thereof a heat sealing polymeric composition, an intermediate polymeric material layer and a top layer comprised of paper, said layers being bonded together by an adhesive.

3. The cartridge of claim 1 wherein said container is cylindrical.

4. The cartridge of claim 1 wherein said container is rectangular in cross-section.

5. The cartridge of claim 4 wherein said cartridge further comprises a leak preventive member overlying said opening below said sealing means.

6. The cartridge of claim 1 which further comprises a polymeric material layer underlying said ink distributing pad.

7. An ink cartridge for a code dating machine having a reciprocating printing head comprising:

(a) a hollow container having a top opening, and an upwardly concave bottom;

(b) an ink absorbing sponge located in said container;

(c) a felt pad located in said container above said ink absorbing sponge having a vacant hole extending therethrough terminating at the bottom of said felt pad and being located a distance from the edge of said felt pad short of the area of contact with said printing head; and (d) a heat sealable laminated cover located over said top opening comprising a lower layer of a metallic foil having on the undersurface thereof a heat sealing composition, an intermediated polymeric material layer and an upper layer comprised of paper, said layers being bonded by an adhesive.

8. The cartridge of claim 7 which further comprises a polymeric material layer underlying said felt pad.

9. The cartridge of claim 7 wherein said container is cylindrical.

10. The cartridge of claim 7 wherein said container is rectangular in cross-section.

11. An ink cartridge for a code dating machine having a reciprocating printing head which contacts said cartridge comprising:

(a) a hollow container having a top opening an upwardly concave bottom, and a shoulder located below said top opening;

(b) an ink absorbing sponge located in said container;

(c) a felt pad located in said container above said ink absorbing sponge having a vacant hole extending therethrough terminating at the bottom of said felt pad and being located a distance from the edge of said felt pad short of the area of contact with said printing head, said felt pad and said ink absorbing sponge being retained in said container by said shoulder;

(d) a heat sealable laminated cover located over said top opening comprising a lower layer of a metallic foil having a heat sealing polymeric composition on the undersurface thereof an intermediate polymeric material layer and an upper layer comprised of paper, said layers being bonded by an adhesive; and (e) a polymeric material layer underlying said felt pad.

* * * * *